US010347984B2

(12) United States Patent
Le Thuc et al.

(10) Patent No.: US 10,347,984 B2
(45) Date of Patent: Jul. 9, 2019

(54) ANTENNA SYSTEM FOR REDUCING THE ELECTROMAGNETIC COUPLING BETWEEN ANTENNAS

(71) Applicants: CENTRE NATIONAL DE LA RECHERCHE SCIENTIFIQUE, Paris (FR); UNIVERSITE DE NICE SOPHIA ANTIPOLIS, Nice (FR)

(72) Inventors: Philippe Le Thuc, Grasse (FR); Robert Staraj, Saint Paul (FR); Aliou Diallo, Nice (FR); Mickaêl Jeangeorges, Nice (FR)

(73) Assignees: UNIVERSITE DE NICE SOPHIA ANTIPOLIS, Nice (FR); CENTRE NATIONAL DE LA RECHERCHE SCIENTIFIQUE—CNRS, Paris (FR)

( * ) Notice: Subject to any disclaimer, the term of this patent is extended or adjusted under 35 U.S.C. 154(b) by 0 days.

(21) Appl. No.: 15/312,352

(22) PCT Filed: May 19, 2015

(86) PCT No.: PCT/EP2015/061025
§ 371 (c)(1),
(2) Date: Nov. 18, 2016

(87) PCT Pub. No.: WO2015/177170
PCT Pub. Date: Nov. 26, 2015

(65) Prior Publication Data

US 2017/0084990 A1 Mar. 23, 2017

(30) Foreign Application Priority Data

May 19, 2014 (FR) ..... 14 54478

(51) Int. Cl.
*H01Q 1/52* (2006.01)
*H01Q 9/04* (2006.01)
(Continued)

(52) U.S. Cl.
CPC ..... *H01Q 1/521* (2013.01); *H01Q 1/243* (2013.01); *H01Q 9/0421* (2013.01); *H01Q 21/28* (2013.01)

(58) Field of Classification Search
CPC ..... H01Q 1/48; H01Q 1/521; H01Q 1/526; H01Q 9/0421; H01Q 21/28
See application file for complete search history.

(56) References Cited

U.S. PATENT DOCUMENTS 5,892,482 A 4/1999 Wong et al.
2008/0258991 A1 10/2008 Montgomery
(Continued)

FOREIGN PATENT DOCUMENTS

EP 0 847 101 6/1998
FR 2968845 6/2012
(Continued)

OTHER PUBLICATIONS

International Search Report for corresponding International PCT application No. PCT/EP2015/061025.
(Continued)

*Primary Examiner* — Robert Karacsony
(74) *Attorney, Agent, or Firm* — Hauptman Ham, LLP

(57) ABSTRACT

Antenna system comprising at least two radiating elements, a first line for neutralizing electromagnetic coupling between the at least two radiating elements, at least one radiofrequency power supply line for each radiating element and at least one short-circuiting line to a ground plane of the antenna system per radiating element, characterized in that the antenna system further comprises: at least one second line for neutralizing electromagnetic coupling between said at least two radiating elements; elements for activating at least some of the neutralization lines; and in that the activation elements are configured to selectively activate or
(Continued)

deactivate at least some of the neutralization lines, in such a way that depending on the activation/deactivation thereof the neutralization lines provide a maximum neutralization of the electromagnetic coupling of the radiating elements for a plurality of different frequencies.

22 Claims, 8 Drawing Sheets

(51) Int. Cl.
*H01Q 21/28* (2006.01)
*H01Q 1/24* (2006.01)

(56) References Cited

U.S. PATENT DOCUMENTS

2010/0304688 A1* 12/2010 Knudsen ..... H01Q 1/525 455/68
2011/0175792 A1 7/2011 Yoon et al.
2011/0237207 A1* 9/2011 Bauder ..... H01Q 1/521 455/78
2012/0013519 A1 1/2012 Hakansson et al.
2014/0078018 A1 3/2014 Wong et al.

FOREIGN PATENT DOCUMENTS

JP 2001057529 2/2001
JP 2011035505 2/2011

OTHER PUBLICATIONS

Canneva, F., et al. "Frequency Reconfigurable Antenna for DVB-H Applications", Microwave and Optical Technology Letters, vol. 53, No. 8, Aug. 2011, pp. 1734-1736.

Diallo, A., et al., "MIMO Performance of Enhanced UMTS Four-Antenna Structures for Mobile Phones in the Presence of the User's Head", 2007, IEEE 1-4244-0878-4, pp. 2853-2856.

* cited by examiner

PRIOR ART

ANTENNA SYSTEM FOR REDUCING THE ELECTROMAGNETIC COUPLING BETWEEN ANTENNAS

TECHNICAL FIELD OF THE INVENTION

This invention generally relates to the field of antennas and more particularly that of miniature antennas of the type used in all sorts of mobile electronic devices provided with wireless means of communication able to receive and to transmit signals in one or several frequency ranges expressed in gigahertz.

PRIOR ART

The rapid change in the market of the electronics industry leads to having to design wireless communicating devices that are increasingly compact that always offer more features. These devices almost always require multiple antenna systems that meet several needs.

On the one hand, these devices have to be able to receive and to transmit in the various frequency ranges corresponding to the various technologies and wireless transmission standards that they integrate. It has become common for a cellular telephone, for example: a mobile telephone of the so-called GSM type, acronym for "Global System for Mobile communications", also integrates a short-range wireless link of the so-called "Bluetooth" type in order to be able to connect the telephone to another device in the vicinity, for example, in order to connect to a personal computer or to a mobile headset. Recent high-end mobile telephones referred to as "Smart Phones" most often include a receiver for a satellite geo-positioning system that operates, for example with the GPS system, acronym for "Global Positioning System". In addition these devices are also equipped to allow for a connection to a local wireless network of the LAN type, acronym for "Local Area Network". Typically, this is a so-called Wi-Fi network that obeys a group of standards referred to as "802.11" published by the North American institute well known under the acronym "IEEE" which as such makes it possible to access the Internet in all public buildings and locations that provide the appropriate wireless access points.

On the other hand, the adding of antennas in the same device is made necessary by the adopting, in particular in Wi-Fi starting with the 802.11n standard, of a communication mode with better performance known under the acronym "MIMO" ("Multiple-Input, Multiple-Output"). This mode of communication favours a "diversity" of implementing means of transmitting and/or of receiving for the same communications link which typically results in the implementation of a diversity referred to as spatial and the simultaneous use of at least two antennas for receiving and transmitting per link. This transmission mode "in diversity" is intended in particular to take into account a phenomenon that is particularly disturbing, which very frequently appears in the urban environment or in a confined environment such as an office building for example, placed wherein the Wi-Fi networks are commonly deployed. A fading effect of the signal received can be observed, known under the name of "Rayleigh fading", which stems from the receiver simultaneously receiving several shifted copies through different paths of the same emitted signal. The latter can be added together but also be subtracted until, if not cancelling, at least very substantially attenuating the signal received. The basic principle of diversity is that the receiver has to be able to have at least two independent copies of the same signal and more preferably as independent as possible. The probability is then low that they fade at the same time which preserves a signal-to-noise ratio (SNR) that is sufficient for good reception of the information transmitted.

Regardless of the motivations that push designers of mobile communicating devices to multiply the number of antennas within the same case, it remains that the latter must remain independent from an electromagnetic standpoint, despite the fact that the size of the cases that receive them tend to decrease which increases their proximity, this in order to be able to effectively take advantage in particular of the transmission mode in diversity and in general to guarantee the independence of the signals received and transmitted.

Indeed when the antennas are close some of the energy injected into an antenna is absorbed by the other antenna and therefore is not radiated. This electromagnetic coupling between antennas substantially degrades the performance of the system.

In order to overcome this problem, as shown in FIG. 1, an innovative technique in reducing the electromagnetic coupling that manifests itself between two radiating elements, 110 and 120, arranged in the vicinity of each other on the same support 100, for example a printed circuit board (PCB), has already been described in patent application FR2968845A1 bearing the title "Antenna system in diversity" published on 15 Jun. 2012. This technique makes it possible to improve the insulation between the accesses of the two radiating elements, 110 and 120, with this insulation being degraded by the electromagnetic coupling which is manifested all the more so between two radiating elements when the latter are close.

This technique consists in placing a metal line, called a neutralisation line 130, between the two radiating elements, which may be different, 110 and 120. The radiating elements typically form so-called PIFA antennas, acronym for "planar inverted-F antenna". The application hereinabove shows that a substantial improvement in the insulation can then be obtained between the supply ports, 111 and 121, i.e. between the input ports through which the radiofrequency (RF) signals supply each one of the two antennas, for a given frequency band. This innovation makes it possible to create multi-antenna systems for applications of the MIMO type that work in diversity or multi-standard applications such as described hereinabove. Note here that, as with any PIFA antenna, the opposite portion, 112 and 122, of each one of the supply ports of the radiating elements, 111 and 121, is connected by a short-circuit to the ground of the PCB.

Another improvement is also described in the application hereinabove that consists in using one or several active components of the variable capacitor type. This is generally a type of diode referred to as "varicap" of which the value of the capacitance can be adjusted according to the direct current (DC) present on its terminals. The inserting of such a device 140 into a neutralisation line makes it possible to dynamically modify and as desired the frequency band for which the maximum neutralisation is obtained.

This solution however has limitations. In particular, the effective variation in the capacitance that can be obtained with such a device is limited, limiting as such the applications that can be covered with the same antenna system.

This solution is therefore not fully satisfactory.

Moreover, other solutions have been developed to reduce the coupling between antennas while still retaining limited encumbrance.

Some of these solutions consist in creating slots in the ground plane in order to limit the transfer of coupling currents between the antennas.

Other solutions provide to use meta-materials to create notch filters between the antennas thanks to their properties linked to the periodicity.

These solutions require specific modifications of the circuit used as a support for all of the electronic components of the object in particular the board comprising the printed circuit (PCB), which is penalising in terms of cost and complexity for production.

This invention therefore has for objective to propose a system of miniature antennas that reduce or suppress at least some of the aforementioned disadvantages. In particular, the invention aims to propose an antenna system wherein the electromagnetic coupling between antennas is satisfactory for a larger variety of frequencies, as such allowing for a larger range of possible applications while still retaining a reduced encumbrance.

SUMMARY OF THE INVENTION

According to an embodiment, the invention relates to a multiple antenna system comprising at least two radiating elements, a first line (130) for neutralising electromagnetic coupling between the at least two radiating elements, at least one radiofrequency (RF) power supply line for each radiating element.

The antenna system further comprises:

at least one second line for neutralising electromagnetic coupling between said at least two radiating elements, elements for activating at least some of the neutralisation lines, and Moreover, the activation elements are configured to selectively activate or deactivate at least some of the neutralisation lines, in such a way that, depending on the activation/deactivation thereof, the neutralisation lines provide a maximum neutralisation of the electromagnetic coupling of the radiating elements for a plurality of different frequencies.

As such, according to the activation/deactivation of at least some of the neutralisation lines by said activation elements, a plurality of separate RF operating modes are obtained for which the insulation of the radiating elements is different and for which no significant electromagnetic coupling is observed between the radiating elements.

As such, by controlling the activation of the neutralisation lines, the electromagnetic coupling is reduced and even suppressed between the radiating elements and this for different operating frequencies of the radiating elements. As such, the invention makes it possible to improve the insulation between the accesses of the two radiating elements, with this insulation being degraded by the electromagnetic coupling that is manifested all the more so between two radiating elements when the latter are close.

The electromagnetic coupling can as such be reduced for separate and possible far apart operating frequencies.

The invention as such offers the possibility of carrying out frequency hopping, as such making it possible to easily switch from one application to another regardless of their respective operating frequencies. For example, via a simple activation/deactivation of the neutralisation lines it is possible to switch from an operating mode based on an operating frequency of 700 MHz to an operating mode based on an operating frequency of several GHz and obtain for each one of these operating modes an electromagnetic coupling that is zero or substantially attenuated.

Inversely, the solution described in patent FR2968845A1 mentioned hereinabove only allows the operating frequency to be modified continuously and in a restricted range.

The invention as such makes it possible to activate elements for personalisation (lines for neutralising and even short-circuiting) that are very dissimilar that can make it possible to obtain substantial variations in the RF behaviour of the antennas.

The invention offers other advantages among which:

the neutralisation lines provide a maximum neutralisation of the electromagnetic coupling of the radiating elements for a given frequency, with this given frequency depending on the activation/deactivation of the activation elements. As such, by modifying the activation/deactivation of the activation elements of the system, the frequency for which the neutralisation of the electromagnetic coupling is maximal is varied. Indeed for each activation/deactivation of the activation elements of the system the insulation between the radiating elements is varied.

the activation elements are configured to selectively activate or deactivate at least some of the neutralisation lines, in such a way that depending on the activation/deactivation thereof, the neutralisation lines allow for an at least partial insulation between the radiating elements, so as to reduce the electromagnetic coupling between said radiating elements, for a given frequency band.

according to the activation/deactivation of the activation elements, the configuration of the insulation is modified between the radiating elements which then in turn modifies the electromagnetic coupling between said radiating elements.

For a desired frequency or frequencies or an operating frequency band of radiating elements, the activation elements are activated/deactivated in such a way that the neutralisation lines provide a maximum neutralisation of the electromagnetic coupling of the radiating elements for said desired frequency or said frequencies or said operating frequency band.

at least one first and one second lines for short-circuiting to a ground plane the antenna system, per radiating element and comprising elements for activating at least some of the lines for short-circuiting, at least one neutralisation line and more preferably all of the neutralisation lines are free of discrete elements.

The at least one neutralisation line does not comprise any discrete element. As such, and particularly advantageously, the system according to this invention makes it possible to reduce, and even suppress, the losses linked to discrete components. Moreover, proposing an alternative to the use of discrete elements not only makes it possible to reduce losses, but also to increase the output, therefore the efficiency, by a decrease in power losses.

Particularly advantageously, the neutralisation lines can be actuated independently as well as simultaneously. In the case where two neutralisation lines are activated and therefore operate at the same time (which implies that some of the activation elements are activated), the decoupling is advantageously in the high working frequency band. Inversely, when a single neutralisation line is activated (implying that some of the activation elements are activated), the decoupling is in the low working frequency band. When a neutralisation line is deactivated, this causes the operating frequencies to fall.

According to an embodiment, a neutralisation line is activated when it is in the on state. It as such allows for an electrical connection between the two radiating elements. A neutralisation line is deactivated when it is in the off state. It therefore does not allow for an electrical connection between the two radiating elements.

The controlling of the neutralisation lines, in addition to that of the antennas, by the activation elements, procures a synergy, made possible by the presence of the switchable short-circuiting tabs. Particularly advantageously, this invention allows the system to be decoupled into two different operating bands for the radiating elements, i.e. the antennas.

The elements for personalisation can be numerous which makes it possible to potentially obtain many RF operating modes that are possibly very different. As such, even with only two compact antennas on the same ground plane it is possible to obtain the following operating modes: diversity, multi-port, multi-standard.

The solution of patent FR2968845A1 with the use of a varicap diode requires that it be known how to analogically generate a DC current that has to be applied to the terminals thereof in order to obtain the value of the capacitance desired for the application. This invention makes it possible to have a digital control, i.e. binary or ON/OFF, that activates the pre-established RF operating modes and that will be much less likely to drift than an analogue system with a variable capacitance whereon a variable direct voltage has to be applied. In order to improve the reliability of the solution of patent FR2968845A1, a variable direct voltage has to be produced and controlled in order to obtain an operation that does not drift, but this would be very penalising in terms of costs.

Optionally, the invention can furthermore have at least one of any of the following optional characteristics taken separately or in combination:

Advantageously, said activation elements are configured in such a way as to allow for the simultaneous activation of at least the first neutralisation line and the second neutralisation line. Particularly advantageously, the first neutralisation line and the second neutralisation line are actuated simultaneously by said activation elements. More generally the system is configured in such a way that at least two neutralisation lines are simultaneously activated. In a non-limiting embodiment, at least one of the neutralisation lines is always activated, i.e. it is always connected to the two radiating elements. In this embodiment, the neutralisation line, preferably, does not comprise an activation element connecting it to the radiating elements but a simple permanent connection.

Advantageously, the neutralisation lines are configured in such a way that depending on the activation/deactivation thereof they provide a maximum neutralisation of the electromagnetic coupling of the radiating elements for a plurality of different frequencies and separated for at least two of them and more preferably separated from each other by at least one factor 1.1 and more preferably by at least one factor 1.2 and more preferably by at least one factor 1.5 and more preferably by at least one factor 2.

As such, it is for example possible through a simple switching of the neutralisation lines carried out by the elements that can be activated to switch from a maximum attenuation of the coupling for a frequency of 1 GHz to a maximum attenuation of the coupling for a frequency of 1.1 GHz or 1.2 GHz or 1.5 GHz or 2 GHz.

According to an embodiment, the system comprises at least one line for short-circuiting the antenna system to a ground plane per radiating element.

According to an embodiment, the system comprises at least one additional line for short-circuiting per radiating element. According to an embodiment, the antenna system comprises binary elements for activating at least some of the lines for short-circuiting.

According to an embodiment, the binary activation elements are configured to independently activate or deactivate the lines for neutralising and short-circuiting the ground plane.

Advantageously, each one of the neutralisation lines has a geometry, in particular a length, a width, a shape and a thickness, conformed to ensure a neutralisation of the electromagnetic coupling of the radiating elements for at least one frequency and preferably for a plurality of frequencies. A neutralisation line, according to this invention, through its geometry, can behave, for example, like a capacitor, an inductance or an impedance, according to the frequency.

According to an embodiment, at least two neutralisation lines connecting the two same radiating elements have lengths and/or shapes that are different.

Preferably, at least one neutralisation line among the first and second neutralisation lines is comprised of a tab or of a micro-stripline. A micro-stripline is for example an electrical line, serving as a guide for an electromagnetic wave propagation, constituted of a conductive ribbon deposited onto a dielectric substrate of which the second metallised face doubles as a ground plane. Advantageously, the neutralisation line does not comprise any discrete elements, which makes it possible to reduce losses. According to an advantageous embodiment, all of the neutralisation lines are comprised only of a tab or of a micro-stripline.

According to an embodiment, the activation elements are binary activation elements.

According to an embodiment, the activation elements, also designated as switching elements, are configured to selectively activate or deactivate each one of the neutralisation lines. They as such make it possible to provide a decoupling for a maximum frequency that depends on the activation of the neutralisation lines.

Advantageously, at least one of the activation elements is a PIN diode. Advantageously, all of the activation elements are PIN diodes.

Advantageously, at least the elements for activating at least some of the neutralisation lines are PIN diodes polarised using a continuous signal (DC) superposed on the RF signals conveyed by the system for selectively, either rendering the PIN diode conductive and allowing the radiating element to which it is attached to become active, or rendering the PIN non-conducting in such a way that the radiating element to which it is attached becomes inactive.

Alternatively, at least some of the elements for activating at least some of the neutralisation lines are diodes of the varicap type.

According to an embodiment, the system comprises two radiating elements and comprises two neutralisation lines connecting between them said two radiating elements.

According to an embodiment, the system comprises at least two radiating elements and comprises at least three neutralisation lines connecting between them said two radiating elements.

According to an embodiment, the neutralisation lines are suspended between the radiating elements. The neutralisation lines are arranged at a distance from the ground plane.

Alternatively, the neutralisation lines are printed on an electronic board carrying the radiating elements.

According to a particular embodiment, the neutralisation lines are integrated or printed in a layer. The system then forms a stack of superimposed layers without any intermediate empty space between the layers and of which one layer forms the ground plane and of which another layer comprises the neutralisation lines and the radiating elements. This makes it possible to simplify the production of the system and the industrialisation thereof.

Alternatively, the neutralisation lines are partially formed by the ground plane, to which are connected conductive elements connected to the radiating elements and partially by these conductive elements.

According to a particular embodiment, the system comprises at least three radiating elements and a plurality of neutralisation lines connecting between them the radiating elements.

According to a particular embodiment, at least some and more preferably all of the radiating elements each have a general shape of a tab and have the following dimensions:

a length between $\lambda/2$ and $\lambda/6$ and more preferably $\lambda/4$, a width between $\lambda/10$ and $\lambda/20$ and more preferably $\lambda/20$, a height between $\lambda/30$ and $\lambda/15$ and more preferably between $\lambda/28$ and $\lambda/20$;

with $\lambda$ being the wavelength of the signal that the radiating element is intended to receive/emit.

More preferably, the length is measured according to the largest dimension of the tab. More preferably, the width corresponds to the width of the tab. More preferably, the height corresponds to the distance between the tab and the ground plane, with the tab extending in a plane parallel to the one wherein the ground plane extends.

According to an embodiment, each neutralisation line is associated with power supply lines of the radiating elements.

According to an embodiment, the neutralisation lines are associated with connecting lines to the ground plane of the radiating elements.

According to an embodiment, the means forming a ground plane comprise a printed circuit board.

According to an embodiment, the radiating elements are of the PIFA type.

According to another embodiment the invention relates to a system of antennas comprising elements forming a ground plane and at least two radiating elements and a first line for neutralising the coupling of the radiating elements characterised in that it comprises at least one second line for neutralising coupling of the two radiating elements. The system further comprises activation elements configured to selectively activate or deactivate each one of the neutralisation lines, making it possible as such to ensure a de-electromagnetic coupling for a maximum frequency which depends on the activation of the neutralisation lines by the activation elements.

Preferably, the activation elements are configured to selectively activate or deactivate each one of the neutralisation lines by making the state respectively on or off of each one of the neutralisation lines.

Preferably, the first line for neutralising coupling of the radiating elements has a first electromagnetic property, typically a first impedance or a first inductance and the second line for neutralising coupling of the two radiating elements has a second electromagnetic property different from the first, typically a second impedance or a second inductance different from the first.

Another aspect of this invention relates to a telecommunications device comprising a multiple antenna system according to any of the embodiments of the invention. The device also comprises a receiver and/or an emitter coupled to said multiple antenna system. The telecommunications device can be a device for receiving or/and transmitting wireless communications. It is for example a mobile telephone.

BRIEF DESCRIPTION OF THE FIGURES

The objectives, purposes, as well as the characteristics and advantages of the invention shall appear better in the detailed description of an embodiment of the latter that is shown in the following accompanying drawings wherein.

The drawings are provided as examples and do not limit the invention. They are block diagram representations intended to facilitate the understanding of the invention and are necessarily to the scale of the practical applications. In particular the relative dimensions of the various elements are not representative of reality.

DETAILED DESCRIPTION OF THE INVENTION

Figure 2A:
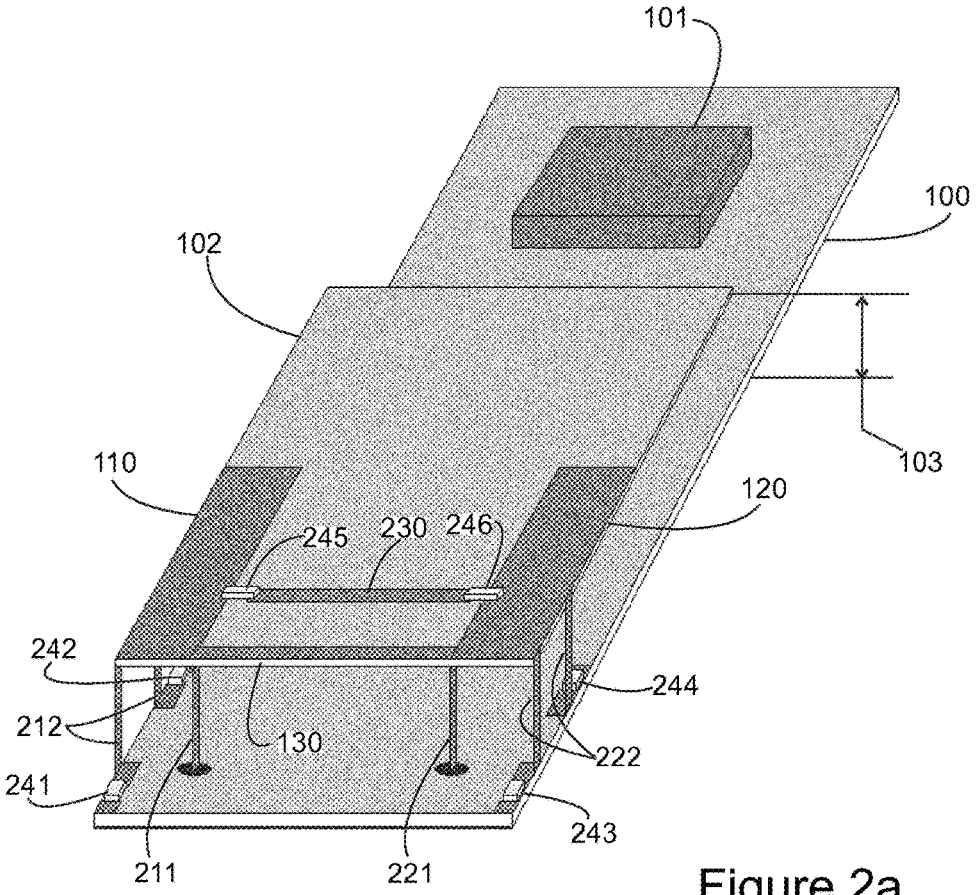
FIGS. 2*a* and 2*b* show an antenna system according to an embodiment of the invention including a neutralisation line and short-circuiting lines that can be programmed using diodes. In this embodiment, the system comprises two radiating elements and two neutralisation lines.
Figure 2B:
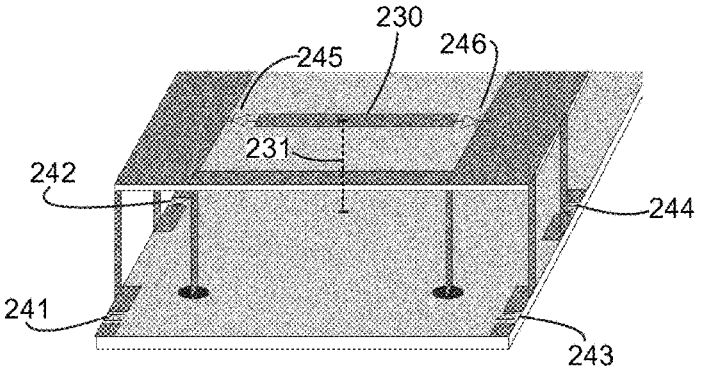

FIGS. 2*a* and 2*b* describe an example of an antenna system according to the invention.

Figure 1:
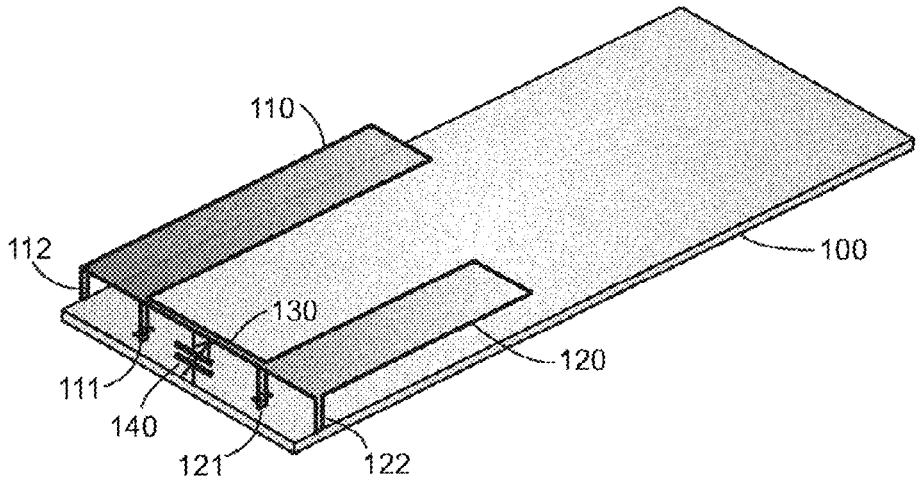
FIG. 1 shows an antenna system of prior art.

The invention consists in improving the technique of the neutralisation line described in FIG. 1 by using simple binary switching components that can then be directly controlled by a digital circuit without the need of generating an analogue DC voltage as is required with a varicap diode. The binary switching components which are likely to be suitable include in particular so-called PIN diodes which include, in addition the doped zones of the P and of the N type of a conventional diode, an intermediate non-doped or intrinsic (I) zone. Such a structure, polarised in the passing direction, advantageously has an extremely low dynamic impedance for the RF signals that pass through it. Polarised in the opposite direction, i.e. blocked, it then on the contrary has a very high impedance with a very low capacitance. These diodes, that can be directly controlled by a digital circuit of the integrated circuit type (IC) 101, make it possible to easily modify, on the fly, the behaviour of the PIFA antennas without having recourse to components of the varicap diode type as described in FIG. 1.

In order to obtain this result the invention combines the use of diodes, on the one hand, with several spatial arrangements of the short-circuiting lines, 212 and 222, radiating elements; and on the other hand, with the adding of at least one second switchable neutralisation line 230 as a supplement to the first neutralisation line 130.

The term neutralisation line means a line connected between two radiating elements 110, 120 that makes it possible, when it is passive, to insulate or to improve the insulation between the supply ports of two radiating elements in order to decrease the coupling observed between said radiating elements 110, 120, for a given frequency band.

Particularly advantageously, at least one neutralisation line 130, 230 does not comprise a discrete element. Advantageously, the neutralisation line 130, 230 is comprised of a micro-stripline. According to another embodiment, the neutralisation line 130, 230 is comprised of a tab. The neutralisation line 130, 230 advantageously has the form of a metal ribbon. It does not have any discrete elements. Only the ends thereof are connected to the activation elements which will be defined in detail hereinbelow and which make it possible to activate or to deactivate the neutralisation line.

Advantageously, each one of the neutralisation lines has a geometry, in particular a length, a width, a shape and a thickness, conformed to ensure a neutralisation of the electromagnetic coupling of the radiating elements for at least one frequency and more preferably for a plurality of frequencies. A neutralisation line, according to this invention, through its geometry, can act, for example, as a capacitor, an inductance or an impedance, according to the frequency.

In order to configure a neutralisation line, in particular in order to determine its geometry and so that it makes it possible to provide an effective neutralisation of the desired frequency or frequencies, the following publications can be consulted:

- "Study and Reduction of the Mutual Coupling Between Two Mobile Phone PIFAs Operating in the DCS1800 and UMTS Bands", published in IEEE TRANSACTIONS ON ANTENNAS AND PROPAGATION, VOL. 54, NO. 11, Nov. 2006, p. 3063-3074, and of which the authors are Aliou Diallo, Cyril Luxey, Philippe Le Thuc, Robert Staraj, and Georges Kossiavas. Reference shall for example be made to sections IV A and IV B.
- "MULTI-ANTENNA SYSTEMS FOR DIVERSITY AND MIMO" doctoral thesis of Aliou DIALLO, UNIVERSITE NICE-SOPHIA ANTIPOLIS, 2007. This thesis is in particular available in the following database: https://tel.archives-ouvertes.fr/tel-00454612/ document. Reference shall be made for example to pages 90 to 100.

The radiating elements are for example PIFA antennas described in FIG. 1.

The diodes number six, bearing references 241 to 246, in the particular example of FIG. 2 which is only a specific and non-limiting example, of an implementation of the invention.

These diodes are typically, as shown, discrete components that can be soldered to the different metal elements comprising the PIFA antennas used in this example intended to illustrate an embodiment of the invention.

The commutation between the multiple physical configurations possible obtained as such, by the intermediary of a suitable polarisation of the diodes, makes it possible to selectively activate or deactivate the short-circuits and the neutralisation lines, and as such to individually control the frequencies to which the antennas are both adapted and insulated. The neutralisation is as such adjusted in order to simultaneously obtain a suitable decoupling of the two radiating elements for each operating mode of the antenna system. The global structure can as such adopt several behaviours defined precisely by the applications under consideration: diversity, multi-standard or multi-access.

In FIG. 2*a*, used to show a particular example of implementing the invention, the components used are PIN diodes. The binary behaviour of these diodes, used in the on or off state, is fixed by a direct current that is greater than or less than a threshold voltage applied directly to the terminals of the latter. In a simple implementation which makes it possible to obtain the switching of the diodes it is possible to advantageously, for example, directly inject the direct current on the access ports of the antennas, 211 and 221. The direct current injected into the antenna system does not disturb the RF signal intended to be radiated by the antennas.

In the case of complex systems that involve multiple diodes, such as the one shown in FIG. 2*a*, it is necessary to create RF/DC decouplings that make it possible to suitably polarise the personalisation diodes. The example of FIG. 2 shows the use of two separate locations for the short-circuiting tabs, 212 and 222, of each antenna which can be programmed using activation elements, advantageously diodes 241 to 244, as well as the use of two neutralisation lines, one fixed 130 and the other able to be programmed 230 using activation elements 245, 246. Advantageously the activation elements are diodes.

All of the configurations shown in FIG. 2*a* can therefore be carried out thanks to the use of the six diodes 241 to 246 in this example. They make it possible to activate or to deactivate any short-circuiting tabs, 212 and 222, as well as the second neutralisation line 230. The first line 130, which is fixed, always connects in this example the radiating elements, 110 and 120, of the two antennas.

In a non-limiting embodiment such as the one shown in FIG. 2*a*, at least one of the neutralisation lines, the line 130 in the embodiment of FIG. 2*a*, is always activated, i.e. it is always connected to the two radiating elements 110, 120. In this embodiment, the neutralisation line 130 therefore does not comprise an activation element connecting it to the radiating elements 110, 120 but a simple permanent connection.

The following non-limiting example shows how a desired operating mode of the multi-antenna system can be chosen, even in the case of two very close standards (PDC and GPS):

- the band referred to as PDC (acronym for "personal digital cellular" in reference to a standard implemented primarily in Japan), ranging from 1465 to 1501 MHz, which is a band of 36 MHz centred on 1483 MHz.
- the GPS band (standard already mentioned), ranging from 1555 to 1595 MHz, which is a band of 40 MHz centred on 1575 MHz.

In the example of the antenna system of FIG. 2*a* it is possible, using six diodes, to already carry out for combinations of antenna mentioned in the table hereinafter. In this table the diodes, of which the reference is mentioned on the first line, are polarised in order to be in the on state if there is a "1" in the corresponding box and blocked if there is a "0".

| Name: | 241 | 242 | 243 | 244 | 245 | 246 | Function: |
|---|---|---|---|---|---|---|---|
| Div1 | 1 | 0 | 1 | 0 | 0 | 0 | Diversity: 2 antennas in the PDC band |
| Div2 | 0 | 1 | 0 | 1 | 1 | 1 | Diversity: 2 antennas in the GPS band |

-continued

| Name: | 241 | 242 | 243 | 244 | 245 | 246 | Function: |
|---|---|---|---|---|---|---|---|
| Multi1 | 1 | 0 | 0 | 0 | 0 | 0 | Multi-port: antenna 1 PDC |
| Multi2 | 0 | 0 | 0 | 1 | 1 | 1 | Multi-port: antenna 2 GPS |

In the "Div2" example, the diodes 242, 244, 245, 246 are activated ("ON" state). In this example, a behaviour in diversity is obtained with the two radiating elements 110, 120 in the same band (GPS). The second neutralisation line 230 makes it possible to decouple the operation of the radiating elements 110, 120 for these high frequencies.

In the "Multi1" example, only one diode 241 is activated. The system as such operates only at the PDC frequency on the access port 211. If only the diode 243 is activated, the system also operates only at the PDC frequency but via another access port 221. The PDC standard therefore has two separate access ports. This "Multi1" solution is combined with the solution of the "Multi2" example (activation of the diodes 244, 245, 246 for an operation at the GPS frequency via the access 221, activation of the diodes 242, 245, 246 for an operation at the GPS frequency via the access 211) in such a way as to form a multi-port system.

This invention therefore makes it possible to propose a multi-standard, multi-port system that can operate in diversity. This is made possible by the actuating independently but also and advantageously simultaneously neutralisation lines 130, 230.

In order to facilitate the manufacture of the antenna system of 2*a* and to ensure its robustness the radiating metal elements 110 and 120 and the neutralisation lines, 130 and 230, can be part of a raised printed circuit 102 whereon will also be soldered the personalisation diodes 245 and 246. The RF power supply lines of the antennas, 211 and 221, as well as the lines for short-circuiting PIFA antennas, 212 and 222, will then be metal vias that pass through the dielectric of the printed circuit 102 in order to be connected to the PCB 100 supporting the integrated circuit. The thickness 103 of the circuit 102 will be adapted to respond to the geometrical characteristics defined for the PIFA antennas under consideration.

FIG. 2*a* shows how the diodes 241 to 246 are electrically connected in this embodiment of the invention.

Figure 3:
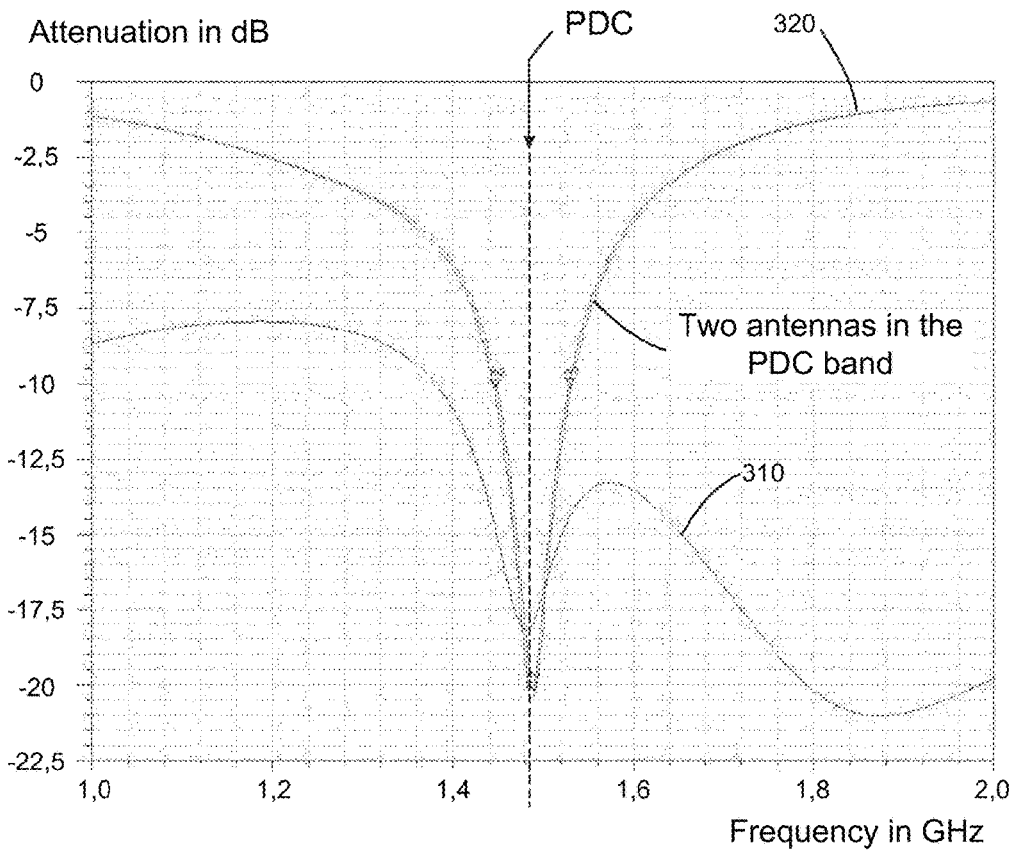
FIG. 3 shows the operation of a dual antenna system according to the invention operating in the PDC frequency band.

FIG. 3 shows the feasibility of the concept.

A substantial electromagnetic coupling between two close radiating elements results in a generally high value of the transmission coefficient between the two so-called S21 antennas 310 measured or simulated between the two access ports 211 and 221. In this figure, it is observed that the fixed neutralisation line 130 makes it possible to obtain a substantial drop of the coefficient S21, and therefore the obtaining of a strong insulation between accesses (therefore a low electromagnetic coupling) for working frequencies of the antennas operating in the PDC band centred on 1.483 GHz. These simulation results are obtained by activating lines for short-circuiting PIFA antennas corresponding to the diodes 241 and 243 in accordance with the table hereinabove. An operation in diversity is indeed observed with the two antennas operating in the same band, the so-called PDC in this case.

Note here that the parameter S21 corresponding to the curve 310, is part of "scattering parameters" or "S-parameters" that are widely used in hyper frequencies to characterise in particular the behaviour of passive or active dipoles. These parameters are used to measure the values of the incident waves, reflected and transmitted by the quadripoles studied. As indicated hereinabove, S21 measures in this case the transmission coefficient between antennas. The two quasi-superimposed curves 320 correspond to the so-called parameters S11 and S22 also called reflection coefficients of each one of the antennas.

Figure 4:
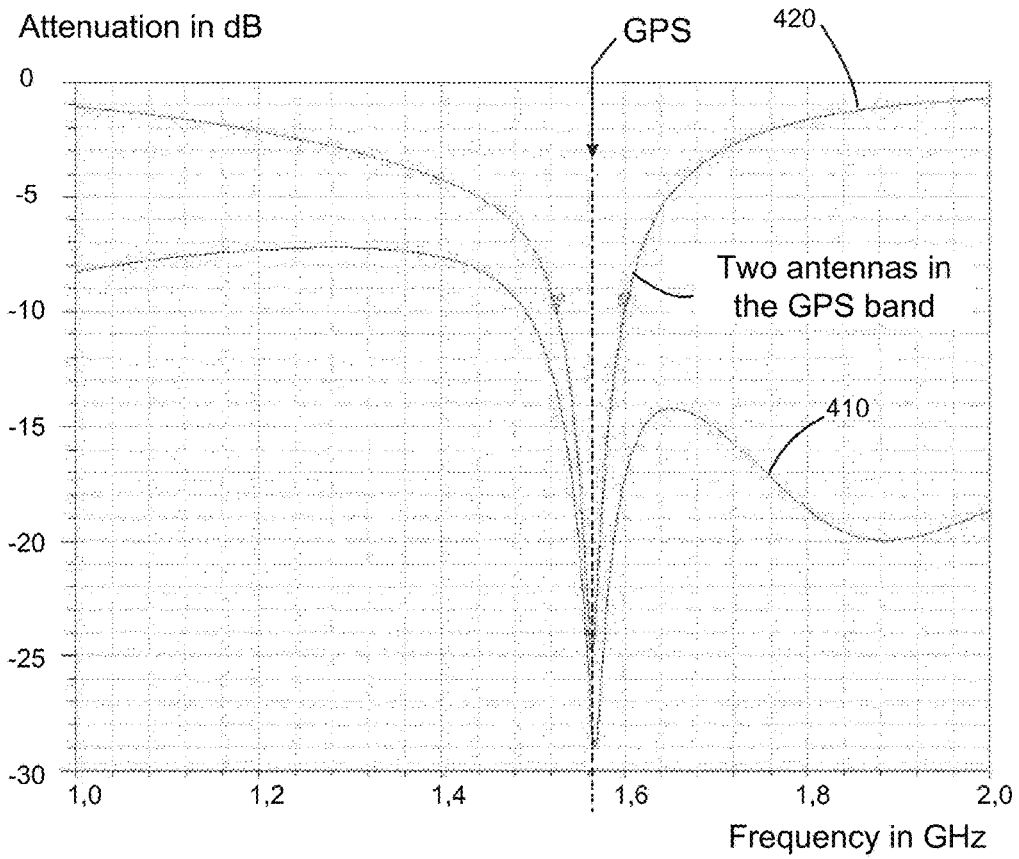
FIG. 4 shows the operation of a dual antenna system according to the invention operating in the GPS frequency band.

FIG. 4 shows the simulation results obtained with the diodes 242, 244, 245 and 246 activated in their on state as shown in the table hereinabove. A behaviour in diversity is indeed observed with the two antennas operating in the same frequency band, that referred to as GPS this time centred on 1,575 GHz. The activation of the second neutralisation line 230, using diodes 245 and 246, makes it possible to decouple the antennas for these frequencies that are higher than the preceding ones in combination with the activation of the lines for short-circuiting PIFA antennas corresponding to the diodes 242 and 244. The same type of curves can be found in this figure as in the preceding figure, i.e. the parameter S21 410 corresponding to the transmission coefficient between the two antennas and the parameters S11 and S22 or reflection coefficients of each one of the antennas corresponding to the quasi-superimposed curves 420.

In reference to FIG. 2*b* note here that the polarisation of the diodes 245 and 246 may require having to apply an intermediate independent polarisation on the neutralisation line 230 that will act only in DC. For example, this can take the form of a thin vertical conductor wire 231 connected to the ground plane of the PCB. At the frequencies transmitted, which are expressed in GHz, the vertical wire 231 which allows for the DC polarisation of the line 230 and therefore those of the diodes 245 and 246, can advantageously be configured and dimensioned in such a way that it alone comprises a "choke" or "shock" for the RF signals transmitted or received. It can also be combined with a discrete component (not shown) in order to comprise a function of the choke type for the RF signals transmitted.

Figure 5:
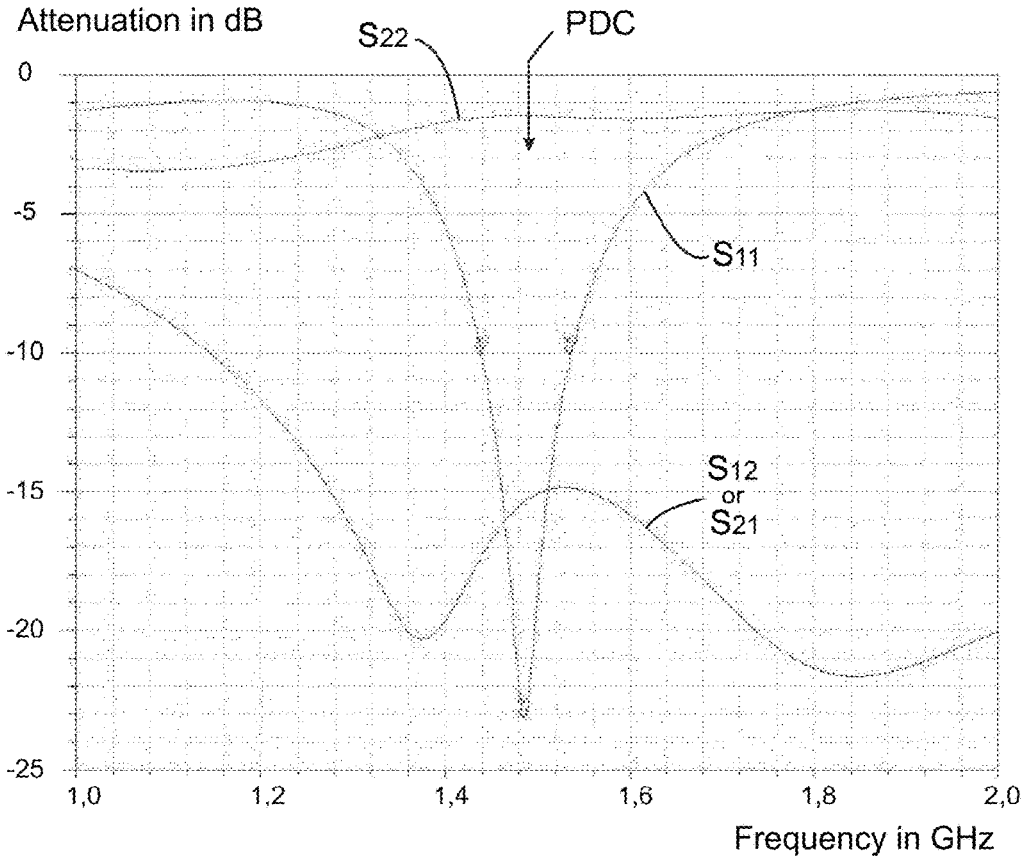
FIG. 5 shows the operation of only one of the two antennas in the PDC frequency band.
Figure 6:
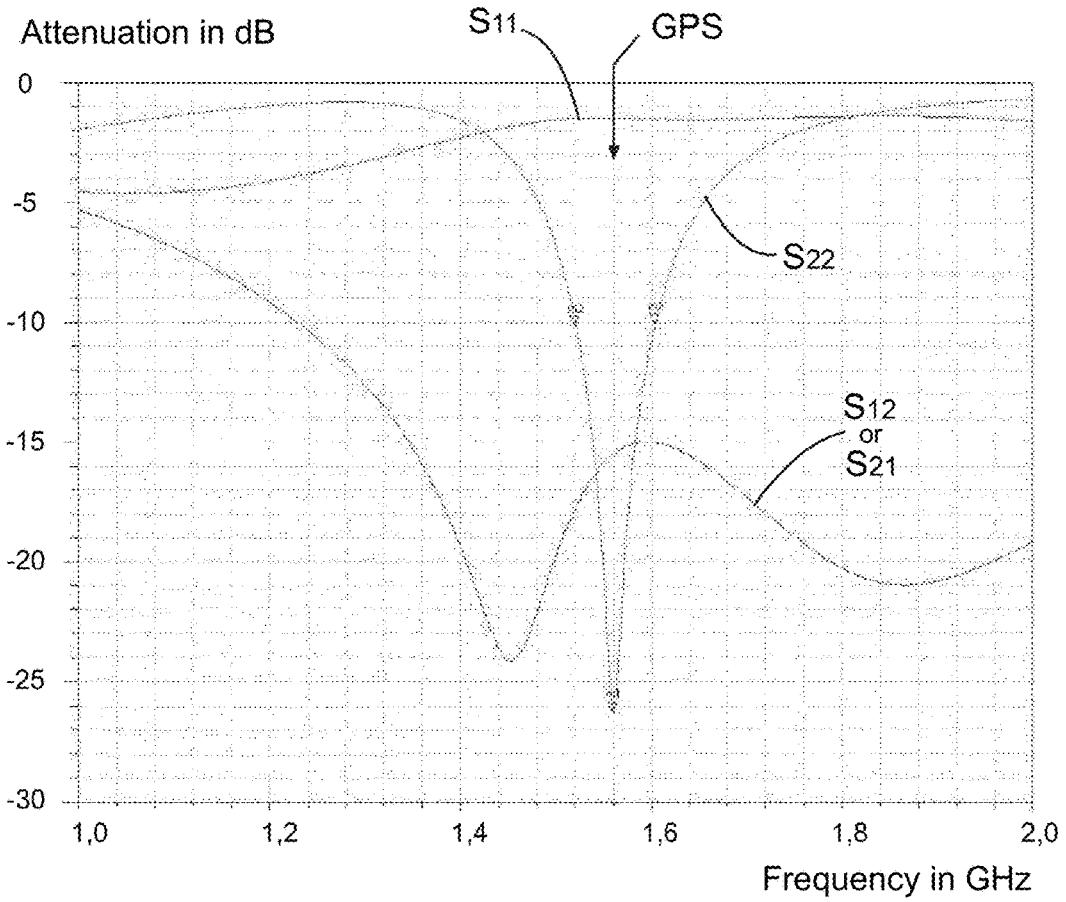
FIG. 6 shows the operation of only one of the two antennas in the GPS frequency band.

FIG. 5 shows the results obtained with only the activation of the diode 241 and of the corresponding line for short-circuiting 212. The system as such operates only at the frequencies of the PDC band on the only antenna of which the radiating element is 110. This solution is optionally combined according to the applications with the case of FIG. 6 that follows wherein the diodes 244, 245 and 246 are activated in their on state in such a way as to activate the second line for neutralising 230 and the line for short-circuiting 222 corresponding to the diode 244, in order to allow for the operation of the only antenna of which the radiating element is 120 in the GPS frequency band in this case, as such forming a multi-port system (PDC or GPS). These figures have the parameters S already described.

The invention therefore makes it possible to propose a multi-standard and multi-port system that can also operate in diversity. All of these features are carried out with only two compact antennas close to one another and a few simple low-cost components (PIN diodes) widely used by the electronics industry. This innovation drastically reduces the complexity of the transmission systems that conventionally use more antennas with reduced performance due to the electromagnetic coupling that exists between antennas located in the vicinity of one another on the same PCB.

The technique of the invention can easily be extended to other frequency bands and be applied to multiple wireless communications technologies. It is also possible to add other switchable lines for short-circuiting on each antenna in order to operate on a larger number of frequency bands simultaneously. In this case, adding one or several switchable neutralisation lines may be necessary.

The example of an antenna system shown in FIGS. 2*a* and 2*b* shall now be described in more detail. Each antenna has the general shape of a tab. Each tab has the following dimensions, with A being the wavelength of the signal emitted/received by the radiating element:

- A length between λ/2 and λ/6 and more preferably λ/4. More preferably, the length is measured according to the largest dimension of the tab.
- A width between λ/10 and λ/20 and more preferably λ/20. More preferably, the width corresponds to the width of the tab.
- A height between λ/30 and λ/15 and more preferably between λ/28 and λ/20. The height corresponds to the distance between the plane wherein the tab extends and the ground plane, typically the integrated circuit the printed circuit intended to receive the other electronic components.

More precisely, for each application the signal is included in a band of frequencies and λ corresponds to the central frequency of the frequency band.

More generally, the range of central operating frequencies of the system according to the invention can typically extend from 700 MHz to about 6 GHz. The system can as such be applied to all of the standards that operate on this frequency band of which in particular the following standards: LTE, GSM, DCS, PCS, UMTS, GPS, WiFi, Bluetooth, Zigbee, WLAN, etc.

Among all of the possible implementations of the invention two are more particularly shown in the following figures.

Figure 7:
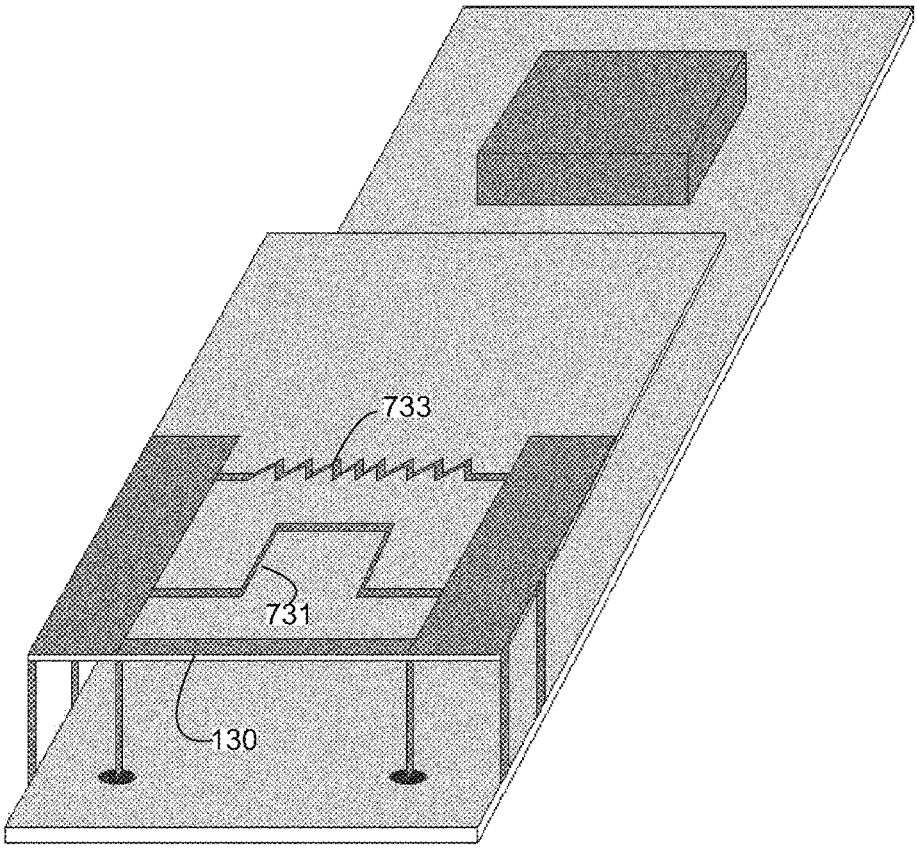
FIG. 7 shows an embodiment of the invention with neutralisation lines of various dimensions and shapes.

FIG. 7 shows the possible use of one or several additional neutralisation lines 731 and 733 in addition to the line 130. In this non-limiting example the line 130 is fixed, i.e. it is always activated (always connected to the two radiating elements). Naturally, the invention also encompasses systems wherein all of the lines are not fixed, i.e. they can be activated or deactivated.

Generally, all of the neutralisation lines can be of various shapes and dimensions which are best adapted by those skilled in the art in particular for the purpose of obtained a minimum coupling between antennas for the applications considered in a manner similar to that which was described for the antennas of the GPS and PDC bands in the preceding figures. As hereinabove, the neutralisation and short-circuiting lines can optionally be fixed, or are able to be programmed in particular using diodes (not shown in this figure), in order to obtain several operating modes using the same antenna system according to the invention.

Figure 8:
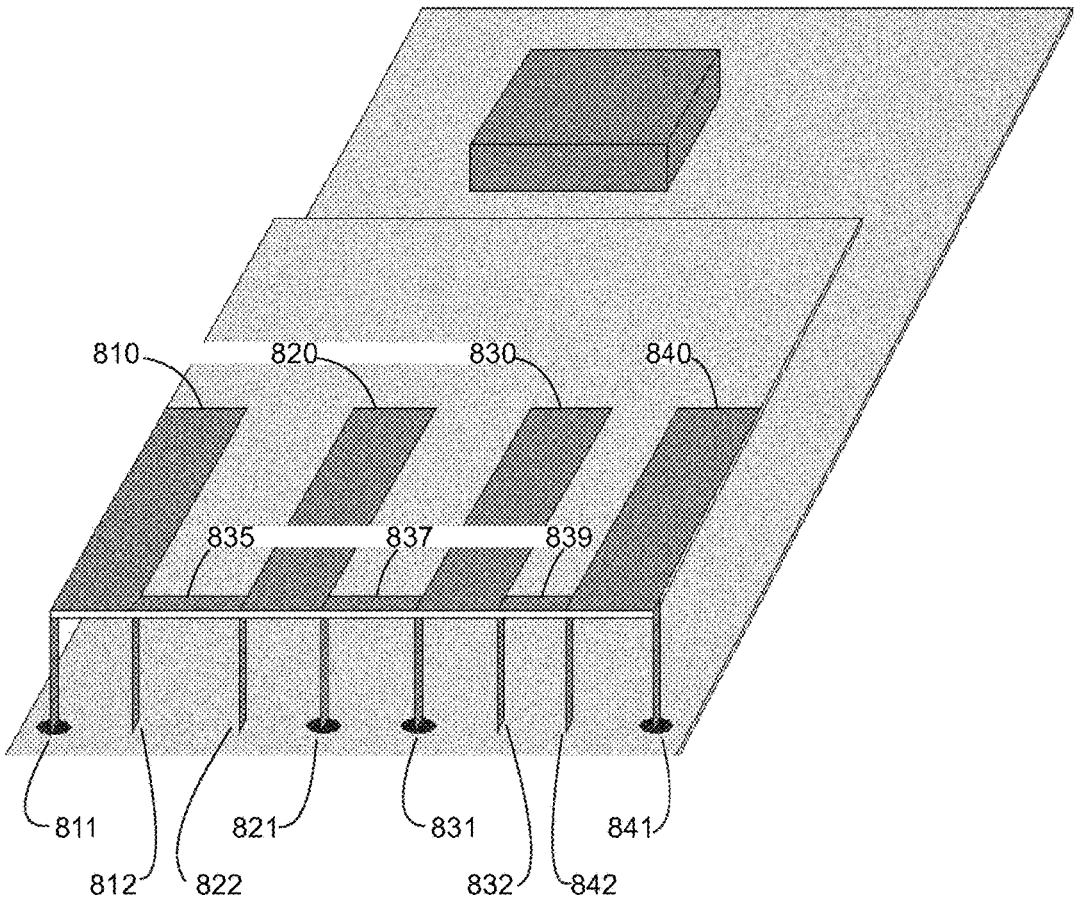
FIG. 8 shows an embodiment of the invention comprising more than two radiating elements separated by more than one neutralisation line.

FIG. 8 shows the case where the antennas and the radiating elements thereof have been multiplied. In the example of FIG. 8 they number four: 810, 820, 830 and 840. They are separated in this case by three neutralisation lines 835, 837 and 839. In order to complete the four PIFA antennas of this example there are, as hereinabove, the power RF signal power supply lines: 811, 821, 831 and 841, comprising the input ports of the antenna system, as well as the lines for short-circuiting: 812, 822, 832 and 842. As hereinabove, additional programmable lines for short-circuiting and for neutralising (not shown) can optionally also be present in this structure.

In another embodiment not shown, at least some of the radiating elements are connected together by several neutralisation lines.

In light of the description hereinabove it clearly appears that the invention proposes a simple solution that is reliable over time and that makes it possible in particular to offer the following advantages:

- Possibility of activating elements for personalisation (lines for neutralising and short-circuiting) that are very dissimilar which can make it possible to obtain substantial variations in the RF behaviour of the antennas (operation in diversity, multi-port, multi-standard), and this even with only two antennas on the same ground plane and in a reduced encumbrance.
- Possibility of carrying out frequency hopping, even for frequencies that are far apart, in such a way as to cover many applications that are possibly very different. The elements for personalisation can be numerous which makes it possible to potentially obtain many RF operating modes that are possibly very different.
- Simple activation using a binary switch (ON/OFF) for carefully pre-calculated elements that do not risk varying over time according, for example, to the environment.
- Lesser cost in that it is possible to directly use the binary signals coming directly from the integrated circuit.
- Improved compactness. For the same performances, without neutralisation line, it is indeed necessary that the elements be farther apart from one another.

The invention is not limited to the embodiments described hereinabove and extends to all of the embodiments covered by the claims.

In particular, although the advantages linked to the use of activation elements have been explained hereinabove in the form of PIN diodes for selectively activating/deactivating the neutralisation lines, all of the embodiments described hereinabove can use varicap diodes as an alternative or in combination with the PIN diodes.

Moreover, although in the figures the radiating elements are identical, the invention covers the embodiments wherein the radiating elements of the same system are different.

The invention claimed is:

1. A multiple antenna system comprising at least two radiating elements, a first line for neutralising electromagnetic coupling between the at least two radiating elements, at least one radiofrequency (RF) power supply line for each radiating element, wherein the antenna system further comprises:

at least one second line for neutralising electromagnetic coupling between said at least two radiating elements; and, elements for activating at least some of the neutralisation lines and, at least one first and one second lines for short-circuiting to a ground plane of the antenna system, per radiating element and comprising elements for activating at least some of the short-circuiting lines, and wherein the activation elements are configured to selectively activate or deactivate at least some of the neutralisation lines and the short-circuiting lines, in such a way that depending on their activation/deactivation thereof, the neutralisation and the short-circuiting lines provide a maximum neutralisation of the electromagnetic coupling of the radiating elements for a plurality of frequencies, the neutralisation lines are suspended between the radiating elements and at a distance from the ground plane.

2. The system according to claim 1 wherein the neutralisation lines are free from discrete elements.

3. The system according to claim 1 wherein said activation elements are configured in such a way as to allow for the simultaneous activation of at least the first neutralisation line and the second neutralisation line.

4. The system according to claim 1 wherein at least one neutralisation line is comprised of a tab or of a microstripline.

5. The system according to claim 1 wherein all of the neutralisation lines are comprised of a tab or of a microstripline.

6. The system according to claim 1 wherein the neutralisation lines are configured in such a way that depending on their activation/deactivation thereof they provide a maximum neutralisation of the electromagnetic coupling of the radiating elements for a plurality of different frequencies and separated from one another by at least one factor 1.1.

7. The system according to claim 1 wherein the activation elements are configured to independently activate or deactivate the neutralisation lines and short-circuiting lines to the ground plane.

8. The system according to claim 7 wherein the activation elements are binary activation elements.

9. The system according to claim 1 wherein each one of the neutralisation lines has a geometry, in particular a length, a width, a shape and a thickness, conformed to ensure a neutralisation of the electromagnetic coupling of the radiating elements for at least one frequency.

10. The system according to claim 1 wherein at least two neutralisation lines connecting the two same radiating elements have lengths and/or shapes that are different.

11. The system according to claim 1 wherein the activation elements are binary activation elements.

12. The system according to claim 1 wherein the activation elements, are configured to selectively activate or deactivate each one of the neutralisation lines.

13. The system according to claim 1 wherein at least one of the activation elements is a PIN diode.

14. The system according to claim 1 wherein all of the activation elements are PIN diodes.

15. The system according to claim 1 wherein at least the activation elements of at least some of the neutralisation lines are PIN diodes polarised using a continuous signal (DC) superposed on the RF signals conveyed by the system for selectively, either rendering the PIN diode conductive and allowing the radiating element to which it is attached to become active, or rendering the PIN non-conducting in such a way that the radiating element to which it is attached becomes inactive.

16. The system according to claim 1 comprising two radiating elements and comprising two neutralisation lines connecting between them said two radiating elements.

17. The system according to claim 1 comprising at least two radiating elements and comprising at least three neutralisation lines connecting between them said two radiating elements.

18. The system according to claim 16 wherein at least one of the two neutralisation lines is permanently activated.

19. The system according to claim 1 wherein at least some and more preferably all of the radiating elements each have the general shape of a tab and have the following dimensions:

a length between $\lambda/2$ and $\lambda/6$, a width between $\lambda/10$ and $\lambda/20$, a height between $\lambda/30$ and $\lambda/15$;

with $\lambda$ being the wavelength of the signal that the radiating element is intended to receive/emit.

20. A telecommunications device comprising a multiple antenna system according to claim 1 and comprising a receiver and/or an emitter coupled to said multiple antenna system.

21. A multiple antenna system comprising at least two radiating elements, a first line for neutralising electromagnetic coupling between the at least two radiating elements, at least one radiofrequency (RF) power supply line for each radiating element, wherein the antenna system further comprises:

at least one second line for neutralising electromagnetic coupling between said at least two radiating elements;

elements for activating at least some of the neutralisation lines;

at least one first and one second lines for short-circuiting to a ground plane of the antenna system, per radiating element and comprising elements for activating at least some of the short-circuiting lines; and, a stack of superimposed layers without any intermediate empty space and of which a layer forms the ground plane and of which another layer comprises the neutralisation lines and the radiating elements, wherein the activation elements are configured to selectively activate or deactivate at least some of the neutralisation lines and the short-circuiting lines, in such a way that depending on their activation/deactivation thereof, the neutralisation and the short-circuiting lines provide a maximum neutralisation of the electromagnetic coupling of the radiating elements for a plurality of frequencies.

22. A multiple antenna system comprising at least two radiating elements, a first line for neutralising electromagnetic coupling between the at least two radiating elements, at least one radiofrequency (RF) power supply line for each radiating element, wherein the antenna system further comprises:

at least one second line for neutralising electromagnetic coupling between said at least two radiating elements;

elements for activating at least some of the neutralisation lines;

at least one first and one second lines for short-circuiting to a ground plane of the antenna system, per radiating element and comprising elements for activating at least some of the short-circuiting lines; and, at least three radiating elements and a plurality of neutralisation lines connecting between said at least three radiating elements, wherein the activation elements are configured to selectively activate or deactivate at least some of the neutralisation lines and the short-circuiting lines, in such a way that depending on their activation/deactivation thereof, the neutralisation and the short-circuiting lines provide a maximum neutralisation of the electromagnetic coupling of the radiating elements for a plurality of frequencies.

* * * * *